United States Patent [19]

Albertsson

[11] 4,257,335

[45] Mar. 24, 1981

[54] INCINERATOR

[75] Inventor: Sören Albertsson, Älvsjö, Sweden

[73] Assignee: Bruun & Sörensen AB, Sweden

[21] Appl. No.: 963,787

[22] Filed: Nov. 27, 1978

[30] Foreign Application Priority Data

Nov. 30, 1977 [SE] Sweden ..... 7713569

[51] Int. Cl.[3] ..... F23G 1/00

[52] U.S. Cl. ..... 110/194; 110/246; 432/106; 432/118

[58] Field of Search ..... 110/194, 246, 247, 251, 110/275, 276; 432/138, 141, 105, 107, 110, 118

[56] References Cited

U.S. PATENT DOCUMENTS

| | | | |
|---|---|---|---|
| 1,742,868 | 1/1930 | Mann | 110/194 |
| 2,625,121 | 1/1953 | Vanderwerf | 110/194 |
| 2,889,143 | 6/1959 | Reaney et al. | 432/110 |
| 3,185,464 | 5/1965 | Meyer et al. | 432/105 |
| 3,323,474 | 6/1967 | Hansen | 110/246 |
| 3,441,259 | 4/1969 | Heyer et al. | 432/118 |
| 3,452,972 | 7/1969 | Beggs | 432/138 |
| 3,819,323 | 6/1974 | Hemsoth et al. | 432/138 |
| 3,837,301 | 9/1974 | Fälling | 110/194 |
| 3,861,335 | 1/1975 | Przewalski | 110/246 |
| 3,998,703 | 12/1976 | Harrell | 110/276 |
| 4,043,746 | 8/1977 | Ritzmann | 432/106 |
| 4,092,098 | 5/1978 | Honaker et al. | 110/246 |

*Primary Examiner*—Henry C. Yuen
*Attorney, Agent, or Firm*—Holman & Stern

[57] ABSTRACT

The invention relates to an incinerator for crematories, including a combustion chamber provided with charge inlet, flue gas outlet, supply means for combustion air, heat supply means and ash outlet. The novelty resides in the fact that the combustion chamber is placed in a unit which is movable, between two positions, relative to at least one stationary end wall in which the charge inlet and the flue gas outlet are provided, and is divided into at least two compartments which communicate with each other at some distance from the flue gas outlet and are adapted to be positioned, one at a time, at respectively the charge inlet and the flue gas outlet. The heat supply means works in the compartment present at the charge inlet at just that moment, and the combustion gases from said compartment will pass the other compartment on their way towards the flue gas outlet. The essential combustion of a charge introduced into the incinerator takes place in the compartment where the heat supply means is working, at the same time as the final burnout of a preceding charge takes place in the other compartment which has been displaced to a position adjacent the flue gas outlet and through which the combustion gases pass on their way to said outlet.

3 Claims, 5 Drawing Figures

INCINERATOR

BRIEF SUMMARY OF THE INVENTION

The present invention relates to an incinerator for crematories, including an incineration or combustion chamber provided with charge inlet, flue gas outlet, supply means for combustion air, heat supply means and ash outlet.

Conventional incinerators for cremation purposes include a combustion chamber in which the incineration takes place. Provided adjacent the combustion chamber is a small compartment which is passed through by the combustion gases and into which the residues of combustion are introduced for final burnout. To permit the intended combustion in prior art incinerators it is necessary successively to push together and shove the combustion material manually during the combustion process, which the staff attending to crematory incinerators feel not only physically but also ethically oppressive. As the displacement of the material is to take place only when a high degree of combustion has been attained, the holding time of each charge must be ample. This must be regarded as a disadvantage from the point of view of energy and time consumption.

The object of this invention is to provide an installation which entirely dispenses with manual handling and displacement of the combustion material or the residues during the combustion process, which permits efficient total combustion in a substantially shorter time than conventional incinerators, and which also makes it possible maximally to utilize the energy supplied.

The essential characteristic of the incinerator according to the invention is that the combustion chamber is placed in a unit which is movable, between two positions, relative to at least one stationary end wall, in which the charge inlet and the flue gas outlet are provided, and is divided into at least two compartments which communicate with each other at some distance from the flue gas outlet and are adapted to be positioned, one at a time, at respectively the charge inlet and the flue gas outlet, that the heat supply means is adapted to work in the compartment present at the charge inlet at just that moment, and that the combustion gases from said compartment will pass the other compartment on their way towards the flue gas outlet, whereby the essential combustion of a charge introduced into the incinerator takes place in the compartment where the heat supply means is working, at the same time as the final burnout of a preceding charge takes place in the other compartment which has been displaced to a position adjacent the flue gas outlet and through which the combustion gases pass on their way to said outlet.

BRIEF DESCRIPTION OF THE SEVERAL VIEWS OF THE DRAWINGS

An embodiment of the incinerator according to this invention will be described more fully hereinbelow with reference to the accompanying schematic drawings, in which.

DETAILED DESCRIPTION

Figure 2:
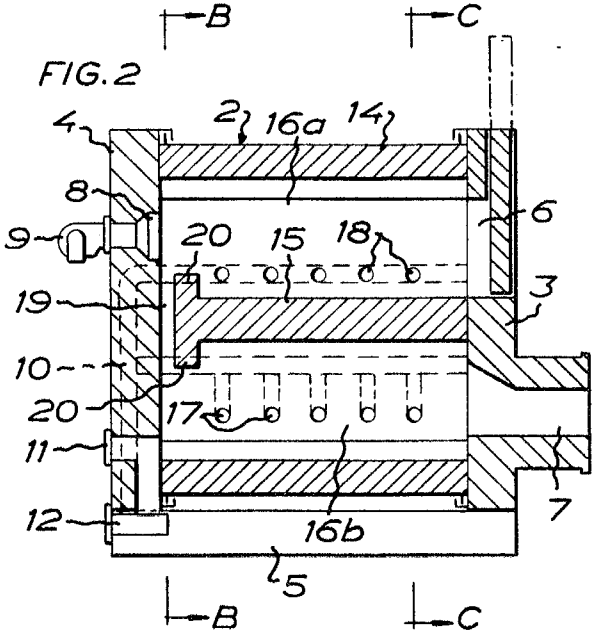
FIG. 2 is a cross-section on line A—A in FIG. 1.

The incinerator according to the invention comprises two main parts, viz. a stationary framework 1 and a rotary unit 2.

The framework 1 consists of two end walls 3 and 4 supported by a base plate 5. One end wall 3 has a charge inlet 6, provided with a sliding lid, and a connection 7 for a flue gas outlet. The other end wall 4 has, flush with the charge inlet, an opening 8 where an oil or gas burner 9 is mounted, a system of air supply ducts 10 and an opening 11 through which ashes can be raked down into an ash chamber 12 provided with a discharge opening.

Provided on the end walls 3 and 4 are bearing means for shafts 13 supporting the rotary unit 2.

The rotary unit 2 consists of a cylindrical circumferential wall 14 surrounding a combustion chamber divided into two compartments 16*a* and 16*b* by a separating vault or wall 15.

Passages 17 and 18 for combustion air, which can be brought into communication with the air duct system 10 in the end wall 4, open into the compartments 16*a* and 16*b*. These passages 17 are inclined in order not to be clogged by combustion residues during rotation of the unit 2 in the direction of the arrows.

The separating wall 15 is slightly shorter than the passage chamber, whereby a combustion opening 19 is formed between the two compartments at that end of the vault which is remote relative to the charge inlet 6. At this end the wall 15 has a protruding edge 20. A connection 21 for combustion air and inspection openings 22 are provided in the end wall 4.

The sides of the end walls 3 and 4 facing the combustion chamber, the rotary unit 2 and the vault 15 consist of a heat-resisting material, masonry or the like. The end walls as well as the rotary unit are suitably built up with a steel structure and covered on their outside by sheet metal or the like.

The combustion process is as follows.

After the incinerator has been heated to the intended temperature a charge of combustion material, i.e. a coffin, is introduced through the opening 6 into the compartment 16*a*, where it will rest on the separating vault 15 exposed to the action of combustion gases on both sides. In the initial phase of the combustion process, during which the combustion material is subjected not only to direct heating from the oil burner but also to intense heat radiation from the heated walls and from the separating vault 15, a rapid destruction of combustible matter takes place, followed by a drying phase during which moisture is removed. This is followed by a second combustion phase in which the main part of the remaining combustible matter is burnt. During the entire process the combustion gases depart via the lower compartment 16*b* to the flue gas outlet 7.

After these phases have been passed through, the oil burner is temporarily shut off and the unit 2 is rotated 180° so that the combustion compartment 16*a*, with the combustion residues contained therein, will take its lower position. During the rotary movement the combustion residues will be pushed together and stirred, which facilitates the subsequent final combustion or burnout.

Figure 1:
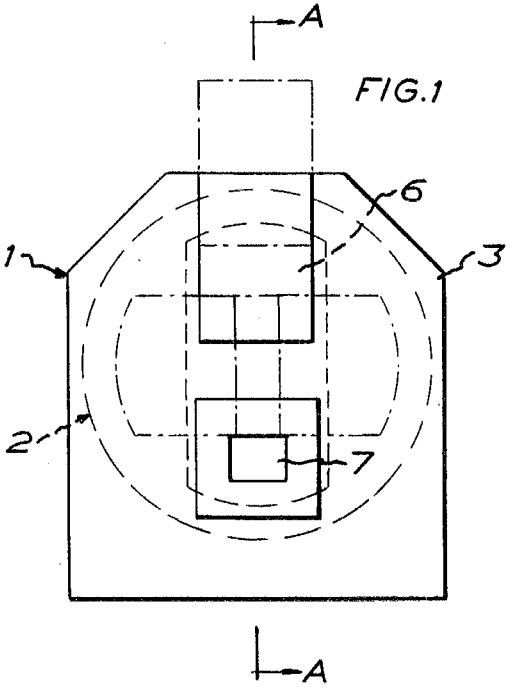
FIG. 1 shows the incinerator as seen from one end wall.
Figure 5:
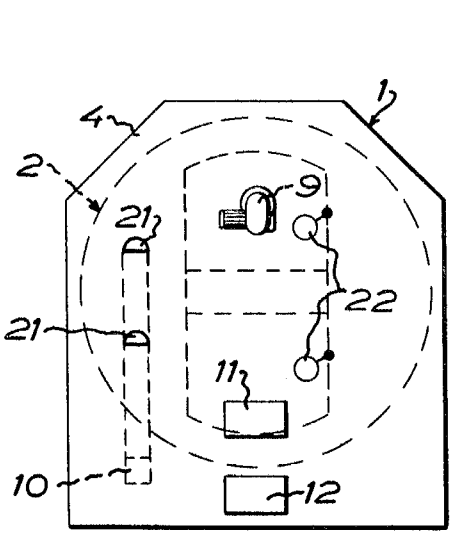
FIG. 5 shows the incinerator as seen from the opposite end wall.
Figure 4:
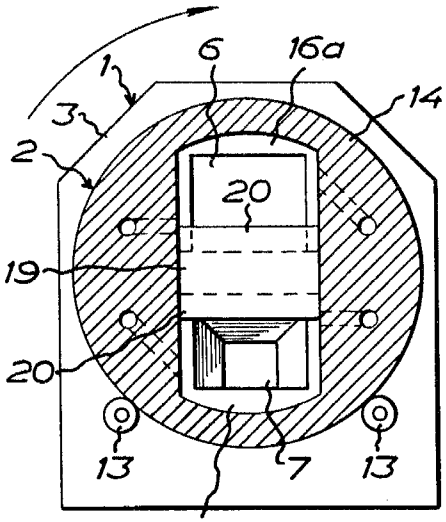
FIG. 4 is a cross-section on line B—B in FIG. 2.
Figure 3:
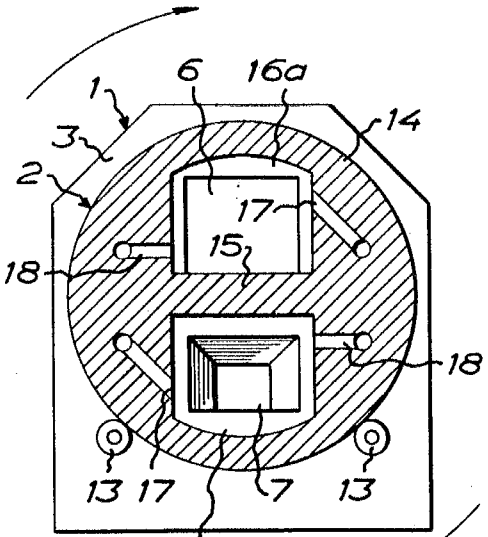
FIG. 3 is a cross-section on line C—C in FIG. 2.

As appears from FIG. 1, where broken lines indicate an intermediate position of the compartments 16*a* and 16*b*, taken during the rotating operation, the flue gas outlet will first be in communication with the compartment 16*b*, then with both the compartments 16*a* and 16*b* and finally with the compartment 16*a* alone. Evacuation of the chamber will thus be secured also during the rotating operation.

In accordance with the illustrated embodiment the air supply ducts are so arranged that the air supply will be temporarily cut off during the rotating operation but it is also possible to obtain air supply during the rotation of the unit 2 through, for instance, bow-shaped slit channels in the end wall 4.

When the compartment 16*a* has reached its lower position another charge of combustion material is introduced through the opening 6 into the compartment 16*b*, whereupon combustion is started again. The hot combustion gases from the compartment 16*b* will now pass through the lower compartment 16*a* while further heating the vault 15, which results in a complete burnout of residues left from the preceding burning period or charge and contained in said compartment.

When the combustion material in the upper compartment has passed the phases mentioned above also the final burnout in the lower compartment is accomplished. Before the unit 2 is rotated again, the remaining ash is raked out so that it will fall down into the chamber 12 from which it can be removed and taken care of. The process is then repeated in the same way.

The drawings do not include apparatus controlling the air supply, oil burners and the like and not either the control means which sense the temperature of the furnace and the composition of the flue gases and, in response thereto, control the function of the oil burner and the supply of primary and secondary combustion air.

In addition to the fact that the incinerator according to this invention eliminates difficult manual operations, it secures a more efficient combustion than what can be achieved with prior art incinerators, by subjecting the combustion material to continuous heating and by stirring it to enable a safe final combustion. The fact that it is possible to displace the combustion residues into another position for continued burnout, after the first phase of the combustion process, and introduce at the same time another charge without any risk of mixing the charges makes it also possible to shorten the time interval between the charging operations, as compared to conventional incinerators, which results in a reduced consumption of energy. It should finally be noticed that also the heat addition received from combustible components of a later charge is utilized for the final burnout of the preceding charge.

The invention should not be considered restricted to that which has been described above and shown in the drawings but may be modified in various ways within the scope of the appended claims.

I claim:

1. Incinerator for crematories comprising a cylindrically shaped hollow drum mounted for rotation horizontally about its central axis, end walls sealingly engaging the ends of said drum to form an enclosed chamber, a separating wall within said chamber extending in a plane through said central axis separating said chamber into two compartments, said separating wall extending from one end wall and spaced from the other end wall to form a passageway communicating with both compartments at said spaced end of said separating wall, a charge inlet through one end wall remote from said passageway communicating with one of said compartments, a flue gas outlet through said one end wall communicating with the other of said compartments, combustible fuel supply means through the other of said end walls communicating with said one of said compartments, an ash outlet through said other end wall communicating with said other compartment, means to supply combustion air to both compartments, and means to rotate said drum intermittently through 180° so that said compartments interchange positions with respect to said charge inlet, fuel supply means, flue gas outlet and ash outlet, the incinerator being adapted so that the essential combustion of the charge takes place in said one compartment into which it is introduced through said charge inlet while the drum is stationary, and final burnout takes place after rotation of said one compartment to the position of said other compartment.

2. Incinerator as claimed in claim 1, wherein said means to supply combustion air includes air supply openings into said compartments which communicate, via supply passages through said drum, with air ducts in said other end wall.

3. Incinerator as claimed in claim 2, wherein said air supply openings are inclined with respect to the intended direction of rotation.

* * * * *